US006469668B1

(12) United States Patent
Jones et al.

(10) Patent No.: US 6,469,668 B1
(45) Date of Patent: Oct. 22, 2002

(54) METHOD AND APPARATUS FOR CONNECTION TO A ROTATABLE ANTENNA

(75) Inventors: Jeffrey L. Jones, Orem, UT (US); Thomas A. Johnson, Draper, UT (US); Steven Lo Forte, Midvale, UT (US); Sy Prestwich, West Jordan, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/488,044

(22) Filed: Jan. 20, 2000

(51) Int. Cl.[7] ..... H01Q 1/24
(52) U.S. Cl. ..... 343/702; 343/906
(58) Field of Search ..... 343/702, 906, 343/905; 455/90; H01Q 1/24

(56) References Cited

U.S. PATENT DOCUMENTS 5,557,288 A * 9/1996 Kato et al. ..... 343/702
5,579,023 A * 11/1996 Blaese ..... 343/851
5,617,106 A * 4/1997 Tahmassebpur ..... 343/702
5,933,116 A * 8/1999 Suesada et al. ..... 343/702
5,949,378 A * 9/1999 Coveley ..... 343/702
5,973,645 A * 10/1999 Zigler et al. ..... 343/702
5,973,652 A * 10/1999 Sanford et al. ..... 343/781 P

* cited by examiner

*Primary Examiner*—Hoanganh Le
*Assistant Examiner*—Ephrem Alemu
(74) *Attorney, Agent, or Firm*—Kirton & McConkie; Michael F. Krieger

(57) ABSTRACT

A hinged or rotatable antenna working in conjunction with a ground plane element which discloses a coaxial cable connection that maintains electrical contact between the ground plane element and the coaxial cable shielding through the use of a compression retainer block or plate. Some embodiments of the present invention also disclose channel geometry for establishing and maintaining an electrical connection between cable shielding and a ground plate element.

6 Claims, 5 Drawing Sheets

METHOD AND APPARATUS FOR CONNECTION TO A ROTATABLE ANTENNA

THE FIELD OF THE INVENTION

The present invention relates to small-scale, rotatable antennas used with restricted profile devices in the computer and communications industry. More particularly, the present invention relates to a method and apparatus for reliably connecting to an antenna radiator which pivots on a hinge or similar mechanism and for connecting to associated ground plane elements.

BACKGROUND

Some standards in the electrical connector industry have been created by government regulation such as the Federal Communications Commission's Title 47, §68.500, otherwise denoted "Subpart F—Connectors" (Subpart F). Subpart F is incorporated herein by reference. Subpart F contains detailed specifications for "miniature" connectors used in the communications industry. Included in this specification are the "Miniature 6-position plug and jack" and the "Miniature 8-position plug and jack." These connectors, commonly known as the RJ-11 connector and the RJ-45 connectors, respectively, are ubiquitous throughout the industry.

The miniature 6-position connector or RJ-11 has emerged as the industry standard connector for telephone lines. RJ-11 plugs and jacks are used on almost all telephone sets for connection to the phone system and consequently are used for standard modem connections which also use these telephone lines. Although most telephone companies use only 4 or 2 of the available positions on the connector, the 6-position connector is the standard.

The miniature 8-position connector or RJ-45 has become an industry standard connector for computer networks. It is used for inter-connectivity between network adapter cards, hubs, routers, switches and other network hardware.

These connectors have been the industry standard for many years and are likely to remain so in the future for telephones, desktop computer modems and network adapters, and other substantially stationary communications equipment. However, hardware technology and the "miniaturization" of components has progressed to the point that the standard, "miniature" RJ connectors have a larger cross-section than the thickness of the hardware to which they connect.

An example of these smaller, thin profile hardware configurations is the PC Card Standard promulgated by the Personal Computer Memory Card International Association (PCMCIA). The PCMCIA PC Card standard identifies three primary card type designations: Type I, II and III. These type designations correspond to physical dimension restrictions or "form factors" of 85.6 mm (length)×54.0 mm (width) and thicknesses of 3.3 mm, 5.0 mm and 10.5 mm respectively. These thin profile expansion cards are used to expand the functionality of computers and related products by adding circuitry contained on the card to the host device. Host devices, such as laptop computers, contain expansion slots which receive the expansion cards and provide electrical connections thereto. Modems and network adapters are often constructed in PC Card standard form factor.

As a consequence of hardware miniaturization in the face of a nearly worldwide RJ connector standard, hardware manufacturers have developed myriad proprietary hardware connection standards and an assortment of connectors and adapters that allow the RJ plugs to be connected to thin profile hardware.

One elegant and convenient connector which allows connection of the standard RJ type plug with thin profile hardware is the XJACK® produced by 3Com Corporation, Salt Lake City, Utah. The XJACK®, shown generally in FIG. 1, is a thin profile connector designed to be contained within hardware such as PC Card standard compliant devices. The XJACK® comprises a thin body 1 with an aperture 3 therein for receiving a standard RJ connector plug 5 such as a miniature 6-pin plug, a miniature 8-pin plug or some other connector. Jack conductors 7 contact plug conductors 9 just as a conventional RJ jack connects. The XJACK® may be retractable within the device or be detachable therefrom. Commonly used XJACK® connectors retract in and out of a device by sliding along a track. A spring is often used to bias the XJACK® connector such that it pops out of its retracted state and remains extended during use.

Wireless communication devices are now becoming commonplace in the electronics industry. Wireless networking of portable computers and associated devices is now replacing a large segment of the networking market. Wireless communication devices including wireless networking adapters, hubs and other equipment utilize radio transmitters and receivers to transmit data signals from one device or node to another. These radio transmitters and receivers must utilize a specific frequency band and protocol to accomplish this task. Since these wireless networks and communications areas may often overlap, standards, protocols and privacy protection are necessary. One current standard in the industry has been established by the Institute of Electrical and Electronics Engineers, Inc. (IEEE) and is known as IEEE 802.11. This standard comprises communications standards, protocol and equipment specifications for wireless communication equipment including privacy and encryption provisions.

Another emerging standard in wireless communications and networking, known as Bluetooth®, is being established by a collaborative group of communications and computing companies. Devices incorporating Bluetooth® technology will utilize a micro-chip transceiver for communications between devices. Bluetooth® devices will transmit in the previously unused 2.4 GHz range. Bluetooth® technology promises to be a viable and economical networking solution for interconnection of cell phones, computers, printers, modems, computer peripherals, fax machines and other communications and computing devices. The size of the Bluetooth® transceiver will make it usable in devices as small as palm computers and cell phones.

Antennas are well known for enabling and improving transmission to radio receivers and from radio transmitters. Antennas can dramatically increase the range of radio transceivers, however most antenna designs function best when protruding from their host device. In small electronic devices protruding antennas are often vulnerable to breakage as the devices are often stowed in purses, pockets, backpacks and other areas where neglect can occur. A retractable antenna is more convenient and durable and occupies less space when retracted.

Because many antennas perform better when oriented in a vertical position, they often must be able to rotate from a horizontal "storage" position to an "in-use" vertical position. For compactness, they may then re-rotate to horizontal before retraction into a host device. This function is often achieved through a hinge or similar mechanism. While this rotation function is easily achieved with known methods and apparatus for the physical antenna itself, it presents a challenge to those designing the electrical connection to the movable or rotatable antenna.

Connection methods are known whereby a contact on one side of a hinge rests on a conductive portion of the other side of the hinge thereby effectuating electrical contact therebetween. However, this "wiper" technology presents a problem with antenna connections because the impedance of the connection varies considerably as friction, oxidation and corrosion affect the contact between the two materials. This variance in impedance can adversely affect the performance of a low power antenna such as those used with short-range wireless devices.

Conventional "flex" cables are also known for connection to a rotatable or movable extension or device. However, these connectors often require a minimum bend radius that precludes their use in more compact movable parts.

SUMMARY AND OBJECTS OF THE INVENTION

The present invention relates to small-scale rotatable antennas used in conjunction with electronic devices or extensions thereof. These hinged or otherwise rotatable antennas may connect directly to a small electronic host device or to a retractable extension thereon, however the electrical connection must be able to flex or rotate with the movement of the antenna. These antennas may also function in conjunction with ground plane elements.

When a coaxial connection cable is used to connect an antenna/ground plane combination to a transceiver, the ground plane element is connected to the shielding conductors and the central coaxial wire is connected to the antenna radiator or the central coaxial wire becomes the radiator itself. If the antenna radiator is rotatable, the coaxial cable connection or conductors in the coaxial cable themselves must be able to flex with the rotation of the radiator. The conductors in the cable shielding and the radiator conductor must be able to deform elastically as the antenna is deployed and stowed over the life of the device. If either the shielding or the radiator conductor fails, the antenna will not function properly and device performance will be compromised. Therefore, a reliable method and apparatus for connection to the antenna is desirable.

Embodiments of the present invention comprise an antenna housing which is pivotally connected to an electronic device or extension thereof. The antenna housing pivots from a substantially vertical "usable" position to a substantially horizontal "storage" position. As the antenna housing is moved from the usable position to the storage position it pivots along a hinge axis. In some embodiments of the present invention, at one end of this axis, a conductor enters the antenna housing and connects to or transitions into an antenna radiator contained in the housing. In some other embodiments, the coaxial cable may enter the antenna housing from the side of the hinge and substantially perpendicular to the axis of rotation of the hinge.

A ground plane element is located adjacently and preferably centrally to an initial segment of the antenna radiator. This ground plane element may be integral to the host device or an extension thereof or may be on a surface thereof. In preferred embodiments of the present invention, the ground plane element may be a conductive material which is insert molded, cold or heat staked, or adhesively bonded to the extension. For example, and not by way of limitation, conductive mesh molded into a plastic housing or extension, a conductive foil element sandwiched into a housing or extension, or a conductive plate heat-staked to a device or extension.

The ground plane element will preferably be exposed along a channel in the device housing or extension in which coaxial cable will pass as it connects to the antenna radiator. As the cable passes through the channel with an exposed ground plane element the cable shielding is bared so that it will contact and electrically connect with the ground plane element.

Contact between the cable shielding and the ground plane element is enhanced by the cross-sectional shape of the channel and a compression-fit retainer block, plate or other element which biases the cable against the ground plane element. The cross-sectional shape of the channel and the size of the channel are set so as to achieve a mild compression of the cable in the channel when the retainer block, plate or other element is assembled into place. This compression maintains a positive connection between the ground plane elements and the cable shielding during the life of the device. Preferred lateral cross-sectional channel shapes include, but are not limited to a semi-circle, a v-shaped cross-section and a rounded v-shape.

This connection may also be enhanced by varying the longitudinal shape of the cable channel. Positive results have been obtained with a channel which tapers to a narrow "neck" near the center of the channel thereby forcing increased compression and deformation of the cable at that point and allowing the ends of the cable to flex more freely.

The retainer block, plate or other retaining element of the present invention may be constructed to have a snap-fit assembly, a heat-staked assembly, bonded assembly or some other assembly as is necessary for optimal economy.

Certain embodiments of the present invention may also comprise a "modified monopole" antenna. The modified monopole antenna has a radiating element which typically protrudes substantially vertically from a ground plane element and curves away from device circuitry then curves back toward the vertical forming a shape that may be angular or curved. The shape has been found to improve antenna performance from that of a strictly vertical antenna located at the edge of a ground plane. The shape allows the antenna to protrude from near the center of the ground plane element and then curve away from device circuitry which may produce interference. The antenna typically terminates in a substantially vertical direction.

Accordingly, it is an object of some embodiments of the present invention to provide a rotatable antenna with a secure electrical connection to a host device.

It is also an object of some embodiments of the present invention to provide a secure connection to an antenna ground plane element.

These and other objects and features of the present invention will become more fully apparent from the following, description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the system and apparatus of the present invention, as represented in FIGS. 1 through 6, is not intended to limit the scope of the invention, as claimed, but it is merely representative of the presently preferred embodiments of the invention.

The currently preferred embodiments of the present invention will be best understood by reference to the drawings, wherein like parts are designated by like numerals throughout.

The Personal Computer Memory Card International Association (PCMCIA) promulgates the PC Card Standard for thin profile or thin architecture expansion cards for electronic devices. The PC Card standard designates the physical dimensions of the cards as well as the electrical configuration of the cards including the 68-pin interface between the card and the host device. The physical dimensions of cards conforming to this standard are 85.6 mm in length by 54.0 mm in width. Several thickness variations fall within the standard and are designated by type designation. Type I, II, and III PC Cards have thicknesses of 3.3 mm, 5.0 mm and 10.5 mm respectively. Any references to the PC Card Standard or PCMCIA card standard refer to electronic cards substantially conforming to this standard as described herein.

Figure 1:
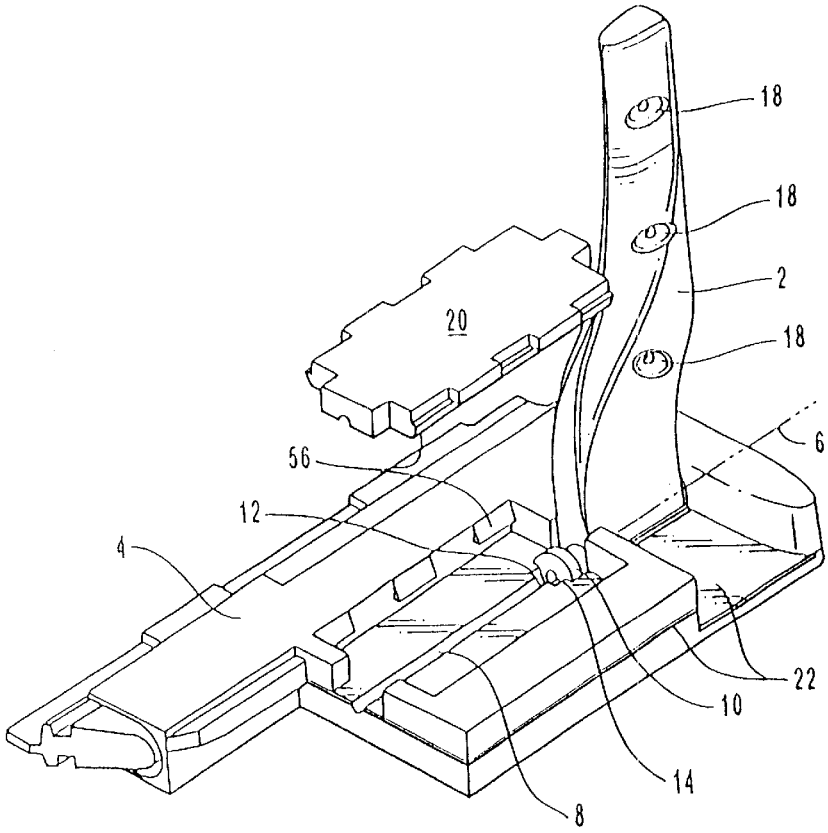
FIG. 1 is a perspective view of an embodiment of the present invention with antenna in a deployed and usable position.
Figure 2:
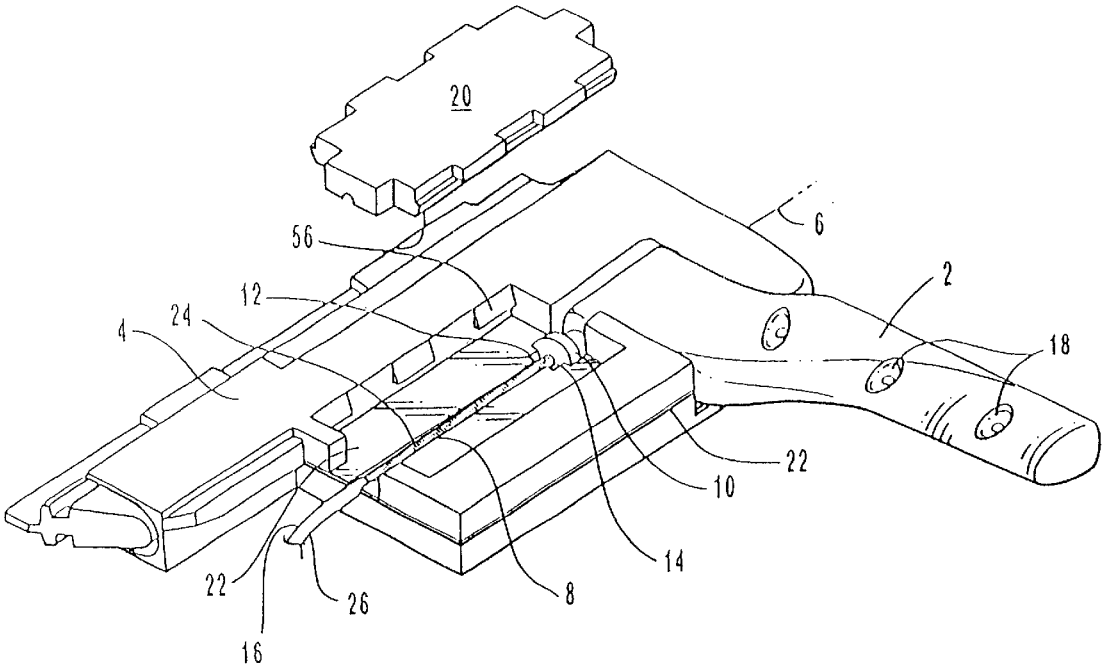
FIG. 2 is a perspective view of an embodiment of the present invention with antenna in a storage position.

In reference to FIGS. 1 and 2, a first embodiment of the present invention comprises an antenna 2 which is hingeably attached to an extension 4. Extension 4 is configured to be received by an electronic device such that extension 4 may be extended or retracted into the device as needed. Antenna 2 may be hinged or pivoted about axis 6 in order to move antenna 2 from a substantially horizontal storage position to a substantially vertical position where antenna 2 may be used for wireless communications functions. Antenna 2 and axis 6 may be oriented in almost any configuration useful for deploying antenna 2 and improving performance thereof.

Figure 3:
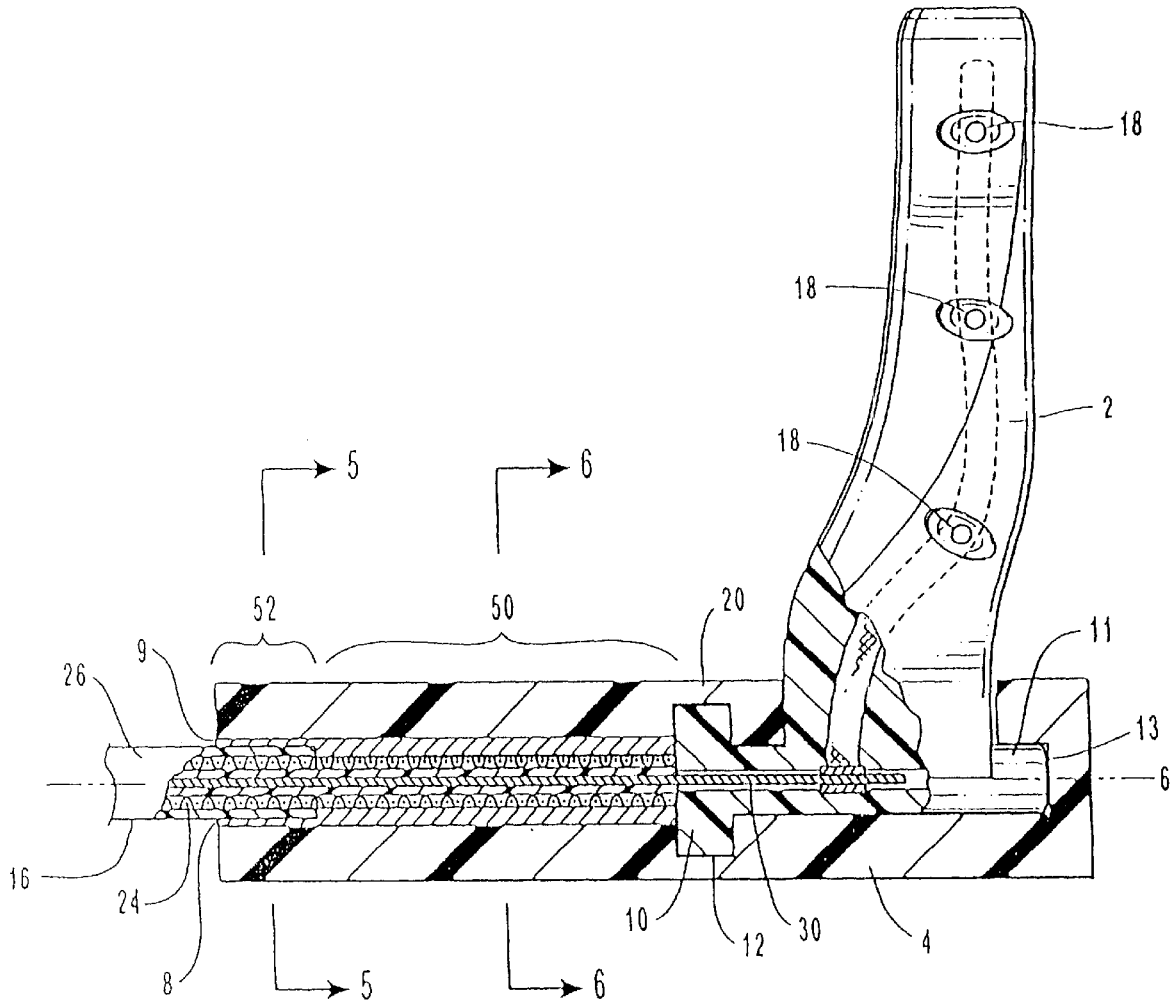
FIG. 3 is a cross-sectional view of the embodiment of the present invention shown in FIG. 1.

Any attachment mechanism that allows antenna 2 to be repositioned from a storage position to a usable position while maintaining a portion of antenna 2 in contact with extension 4 or a similar device. In a first exemplary embodiment of the present invention, as shown in FIGS. 1, 2 and 3, a pivoting hinge-type device is used to allow antenna 2 to rotate around axis 6 while aperture 14 maintains a fixed position relative to extension 4. This prevents displacement and shearing of cable 16 during rotation and deployment of antenna 2. This exemplary embodiment comprises a hub 10 and pin 11 which rotatably engage recesses 12 and 13 to cooperatively effectuate a hinge-like mechanism. Aperture 14 within hub 10 is axial to axis 6 such that rotation of antenna 2 about axis 6 causes no displacement of aperture 14, but only rotation thereof.

Figure 4:
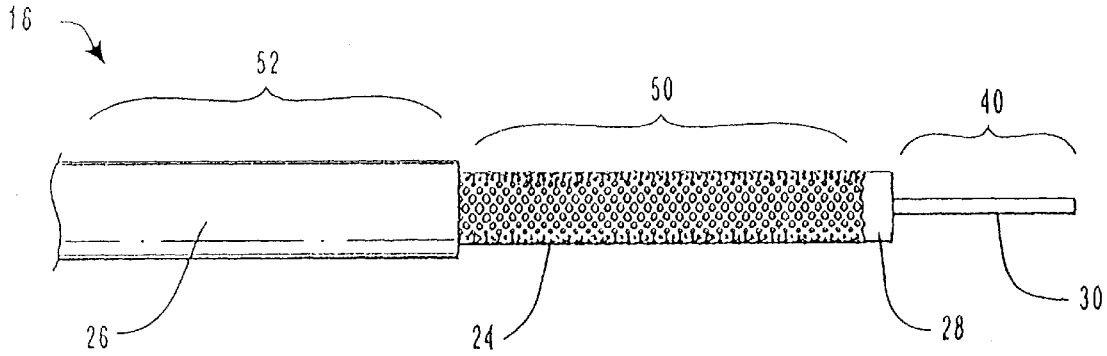
FIG. 4 is a longitudinal cross-sectional view of a cable as prepared for use with an embodiment of the present invention.

In this embodiment, extension 4 also comprises a channel 8 for receiving a coaxial cable 16 which connects to antenna 2. Aperture 14 is configured to receive cable 16 for connection to antenna radiator 18 or extension thereof as antenna radiator 18. Cable 16 may have various configurations, but will preferably have a coaxial configuration as shown in FIG. 4. This type of coaxial cable comprises a primary conductor 30 which may connect to a radiating element or receiving element or may serve as a radiating or receiving element itself Primary conductor 30 is surrounded by inner insulating layer 28 which maintains and defines the impedance of the radiator and protects conductor 30. Inner insulation layer 28 is surrounded by shielding layer 24 which is typically comprised of a thin conductive mesh which is braided around insulation layer 28 or a thin conductive foil wrapped around insulation layer 28. Finally, an outer jacket 26 covers shielding layer 24 and provides electrical insulation for shielding 24 and impact and abrasion protection for cable 16.

Channel 8 is specifically designed to receive, retain and provide electrical connection with coaxial cable 16 as explained below.

This first exemplary embodiment of the present invention may further comprise a retainer block 20 which engages extension 4 and retains cable 16 in place. Cable 16 is retained through the use of block channel 9 which cooperates with channel 8 to encompass and retain cable 16. Channels 8 and 9 also serve to electrically connect cable shielding 24 with ground plane elements 22.

Figure 5:
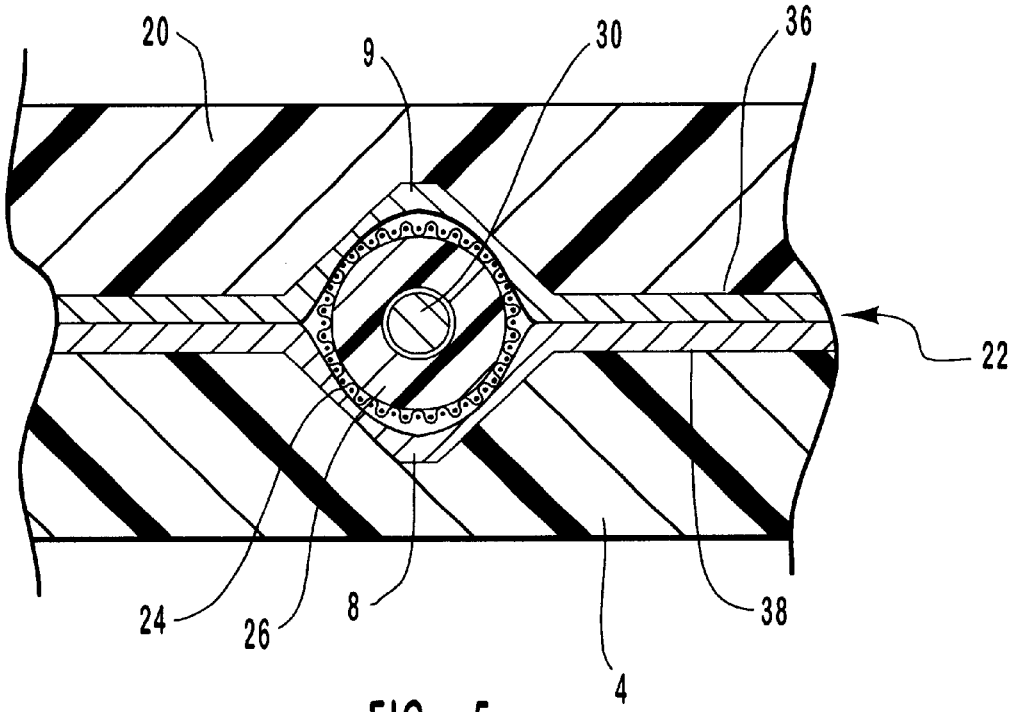
FIG. 5 is cross-sectional view of an embodiment of the present invention showing the channels which receive and retain a cable.

Ground plane elements 22 may be located on various surfaces of extension 4 or may be located within extension 4 either sandwiched in layers or otherwise. Ground plane elements 22 may be constructed with conductive mesh, conductive foil, conductive materials such as metals or conductive plastics or other elements. In a preferred embodiment, ground plane elements 22 within extension 4 extend into channel 8, as shown in FIG. 5, where they can come in contact with shielding 24 on cable 16. As shown in cross-section in FIG. 5, ground plane elements 22 may be conductive elements on the lower surface 36 of block 20 and/or the upper surface 38 of extension 4 and may extend onto the surfaces of channels 8 and 9 so as to contact exposed shielding 24 in channels 8 and 9 and form an electrical connection therewith. Some embodiments of the present invention comprise a channel 8 and/or channel 9 with a rounded, v-shaped cross-section which causes an interference fit between cable 16, channel 9 on retainer block 20 and channel 8 on extension 4 when retainer block 20 is assembled with extension 4.

As shown in FIG. 4, prior to assembly with extension 4, cable 16 is prepared with a small end section 40 of primary conductor 30 where shielding 24 is removed so that conductor 30 may radiate or form a connection with a separate radiator 18 in antenna 2. An adjacent ground contact section 50 of cable 16 has shielding layer 24 exposed while primary conductor 30 is insulated within inner insulation layer 28. This ground contact section rests in channels 8 and 9 where it contacts ground plane elements 22 for electrical communication therewith. Subsequent sections of cable 16 retain outer jacket 26 to protect shielding 24 so that cable 16 may be pinched, crimped or otherwise secured to extension 4.

Electrical connection between end section 40 and radiator 18 may be achieved by a variety of methods including, but not limited to, a threaded connection, a crimped connection, a soldered connection, a welded connection and other known connections and combinations thereof. An extension of primary conductor 30 may also be used as radiator 18 thereby eliminating a need for a mechanical connection thereto. Cable 16 may also be formed integral to radiator 18 and antenna 2 using known plastic molding techniques or other assembly methods.

Regardless of the configuration of cable 16, retainer block 20 and channels 8 and 9 are configured to positively lock cable 16 into a fixed position on extension 4 and to maintain electrical contact between shielding 24 and ground plane elements 22. To achieve these purposes, channels 8 and 9 may be divided into sections with varying textures and shapes. Channels 8 and 9 may have a ground contact section 50 where the cross-sectional shape of channels 8 and 9 are sized to achieve an interference fit between ground contact section 42 of cable 16 and conductive surfaces in channels 8 and 9. This may be achieved with a v-shaped, rounded v-shaped, semi-circular or other channel cross-sectional shape. Channels 8 and 9 may have another securing section 52 proportioned to achieve a securing interference fit with fully jacketed section 44 of cable 16. Channels 8 and 9 of securing section 52 may be textured to increase friction against cable jacket 26 or may have a coating or other treatment to better secure cable 16 to extension 4 and block 20. To further protect cable 16, the end of channels 8 and 9 may be finished with a radius or chamfer to reduce stress on cable 16 from bending and pulling. When cable stress is not present, securing section 52 of channels 8 and 9 may be eliminated.

Figure 6:
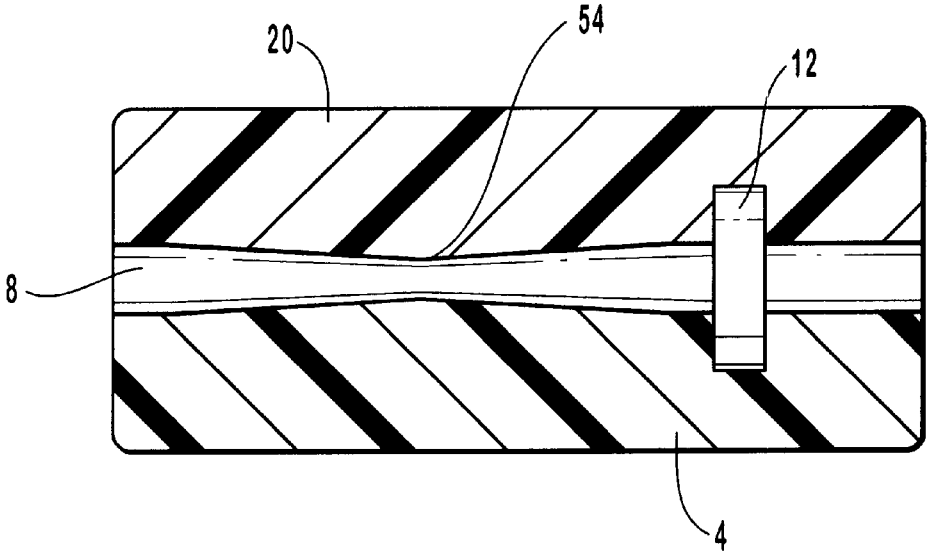
FIG. 6 is a plan view of the extension of an embodiment of the present invention showing a tapered channel.

Channels 8 and 9 may also vary in cross-sectional shape along their longitudinal dimension. In one embodiment of channels 8 and 9, as shown in FIG. 6, channels 8 and 9 taper to a narrower cross-section at one or more points 54 along their length. This taper improves contact between ground plane elements 22 and shielding 24 and physically secures cable 16 in channels 8 and 9 thereby preventing its unwanted removal.

Ground plane elements 22 may also be integral with, molded into or sandwiched within elements of extension 4 or retainer block 20. Ground plane elements 22 may be directly exposed to contact with cable shielding 24 within channels 8 and 9 or may be connected to cable shielding via conductive plates, wires or other elements.

Retainer block 20 may be engaged with extension 4 using interlocking tabs 56, screws, bonding agents or other conventional fasteners.

Figure 7:
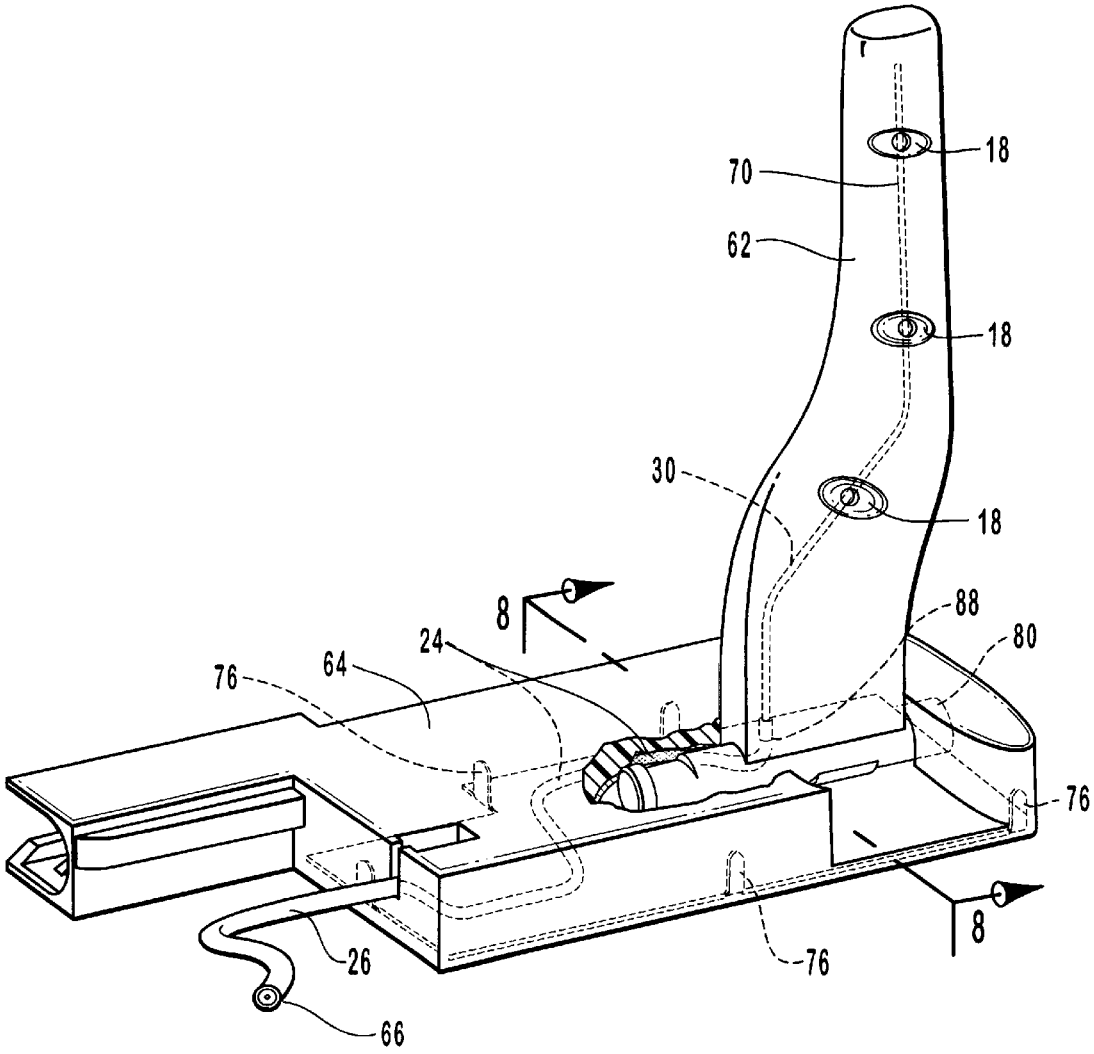
FIG. 7 is a perspective view of an alternative embodiment of the present invention.
Figure 8:
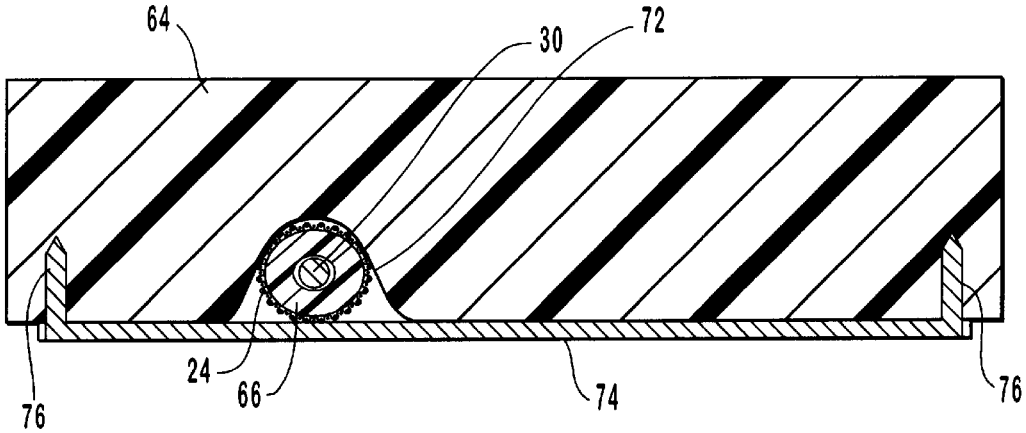
FIG. 8 is a cross-sectional view of an alternative embodiment of the present invention.

A second exemplary embodiment of the present invention, as shown in FIG. 7, comprises a rotatable antenna 62, hingeably connected to a device or device extension 64. Coaxial cable 66 comprises a fully jacketed section 44, a ground contact section 42 with exposed shielding 24, and a radiating section 68 which extends into antenna 2 forming a radiating element 70 therein. In this second exemplary embodiment, radiating element 70 comprises a modified monopole antenna radiator which initially extends perpendicularly from extension 64 then bends outwardly away from host device circuitry after which radiator 70 bends back toward its initial perpendicular direction. In this embodiment, radiator 70 is an extension of cable 66 which has had shielding layer 24 removed so that it may radiate.

Extension 64 comprises a channel 72 shaped to receive ground contact section 42 of cable 66. Extension 64 also receives retainer plate 74 which serves to retain cable 66 in place and provide a ground plane for antenna 62. Retainer plate 74 may be constructed of conductive material such as a metal and may extend across a surface of extension 64 or a art thereof. Retainer plate 74 may be attached to extension 64 with stakes, clips, bonding elements or other means. When plate 74 is attached to extension 64, plate 74 compresses cable 66 into channel 72 thereby causing a compression fit between cable 66, retainer plate 74 and channel 72. This compression fit ensures a continuous electrical connection throughout the length of ground contact section 42. This connection is critical to ground plane functionality and antenna performance and should be maintained for as long a distance as possible to ensure that cable shielding 24 is fully connected to plate 74 which functions as a ground plane element. The contact area between shielding 24 and plate 74 may be increased by forming channel 72 in a circuitous path so that a longer length of cable 66 is exposed to contact with plate 74.

Figure 9:
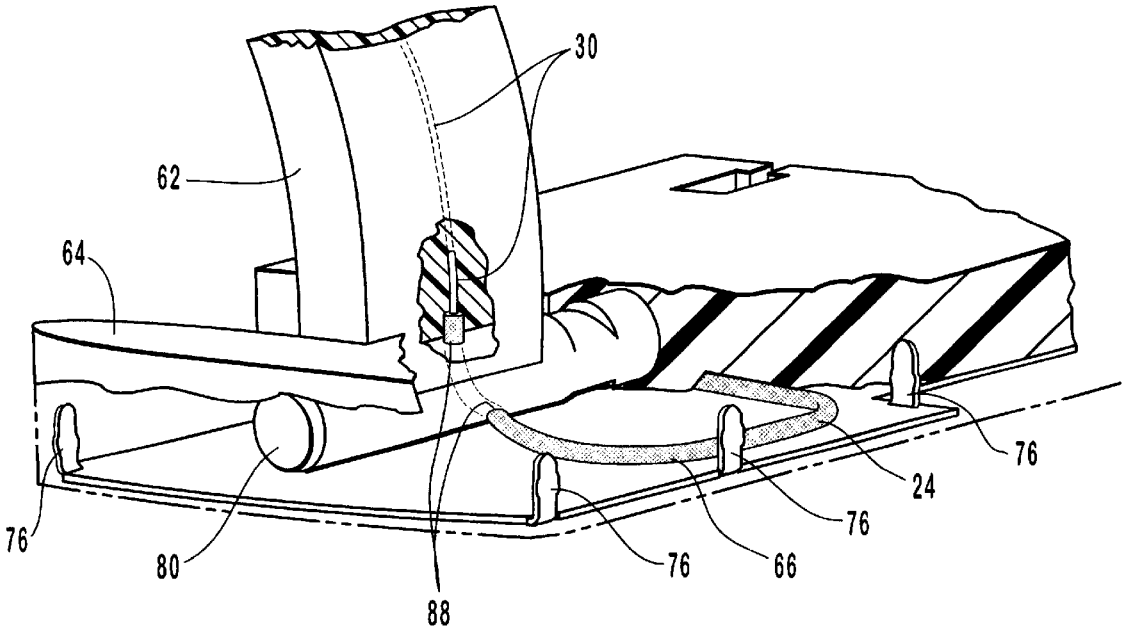
FIG. 9 is a cut away perspective view of an alternative embodiment of the present invention.

In this second exemplary embodiment of the present invention, cable 66 enters antenna 62 through aperture 82 in cylindrical antenna base 80, as shown in FIG. 9. Aperture 82 is sized to allow cable 66 to flex and avoid pinching while antenna 62 is rotated from a usable position to a storage position. The portion of cable 66 within antenna 62 has its shielding stripped away leaving primary conductor 30 exposed as a radiator.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

We claim:

1. An antenna comprising:

an antenna hingeably attached to an electronic apparatus such that said antenna hinges about an axis of rotation;

an aperture in said antenna for connecting to an antenna radiator in said antenna;

a coaxial cable having a longitudinal axis, a shielding layer, and a primary conductor, said primary conductor entering said aperture and being a radiator in said antenna, and wherein said aperture is aligned with said longitudinal axis; and a channel for receiving and securing said cable and for maintaining an electrical connection between a shielding layer of said cable and a ground plane element.

2. The antenna of claim 1, wherein said aperture is axial to said axis of rotation and said cable axially extends through said aperture.

3. The antenna of claim 1, further comprising a retainer block for receiving and retaining said coaxial cable and maintaining electrical contact between said shielding layer and said ground plane.

4. The antenna of claim 1, wherein said channel has a v-shaped cross-section sized to cause mild compression of said cable between said block and said channel.

5. The antenna of claim 1, wherein said channel narrows at a point to increase compression on said cable and further secure said cable.

6. The antenna of claim 1, wherein said antenna is a modified monopole antenna.

* * * * *